United States Patent [19]

Mitrofanov et al.

[11] 4,354,135

[45] Oct. 12, 1982

[54] GEIGER-MUELLER TUBE WITH NICKEL COPPER ALLOY CATHODE

[75] Inventors: Nicholas Mitrofanov, Cleveland; Arthur C. Lucas, Chagrin Falls, both of Ohio

[73] Assignee: The Harshaw Chemical Company, Cleveland, Ohio

[21] Appl. No.: 149,778

[22] Filed: May 14, 1980

[51] Int. Cl.[3] ..... H01J 47/08

[52] U.S. Cl. ..... 313/93; 313/218

[58] Field of Search ..... 313/93, 218

[56] References Cited

U.S. PATENT DOCUMENTS

| | | | |
|---|---|---|---|
| 3,771,005 | 11/1973 | Erickson | 313/218 X |
| 3,784,860 | 1/1974 | Cocks et al. | 313/218 X |
| 3,892,990 | 7/1975 | Mitrofanov | 313/93 |
| 3,902,092 | 8/1975 | Clark | 313/93 X |
| 3,903,444 | 9/1975 | Tessler | 313/93 |

*Primary Examiner*—Palmer C. Demeo

*Attorney, Agent, or Firm*—James A. Lucas

[57] ABSTRACT

A highly sensitive Geiger-Mueller radiation detector with improved temperature stability and working life uses a cylindrical cathode made from a nickel copper alloy preferably containing predominantly nickel. This alloy is resistant to attack by halogen quench gases used in the tube and provides an excellent surface for the electrodeposition of platinum to provide a low porosity surface.

3 Claims, 3 Drawing Figures

GEIGER-MUELLER TUBE WITH NICKEL COPPER ALLOY CATHODE

BACKGROUND OF THE INVENTION

Gas-filled radiation detectors have been used for many years to provide information concerning nuclear radiation. These detectors consist of a hollow cathode defining a gas-filled chamber and an anode within the chamber electrically insulated from the cathode. A voltage is applied between the anode and cathode. When the detector is placed in a radiation field, nuclear particles enter the chamber, causing ionization and the release of electrons. The ions and electrons are collected and analyzed as to energy, type, numbers, etc. The results are typically viewed on an oscilloscope and are recorded and analyzed.

One type of detector is a Geiger-Mueller (GM) detector or tube. A GM tube is characteristically operated in a high voltage range, thereby producing a large output signal which is independent of the nature of the initial ionizing event. Because of its extreme sensitivity, a GM tube can be used to detect all types of nuclear particles including beta, gamma and X-rays.

Geiger-Mueller tubes are presently used for a variety of purposes in research, medicine and industry. Among the varied uses are: detecting and recording particles emitted during experimentation on nuclear radiation; measuring the effect of bombardment on increasing the radioactivity of bombarded products; measuring and identifying fast or slow neutrons emitted from a neutron source; measuring and recording cosmic radiation; detecting and tracing radioactive substances in biological systems; using artifically activated substances to follow the progress of chemical and mechanical changes; and locating oil bearing strata in well logging. Furthermore, these tubes are used in such devices as oil level detectors or gauges on aircraft where they are subject to severe vibration and widely fluctuating temperatures, pressures and altitudes.

The chamber of a GM tube is filled with a monatomic or diatomic gas or a mixture which becomes ionized by radiation. Typically a noble gas such as neon or argon is also used. At the same time, a quench gas is used in the chamber to prevent the occurrence of unwanted secondary ionization caused by the release of electrons from the cathode. The quench gas has a lower ionization potential than the noble gas and dissociates to dissipate the excitation energy after pulsing.

Over the years, several quench gases have been used including organic gases such as ethyl alcohol, ethyl formate and methane, and inorganic halogen gases such as bromine and chlorine. The use of bromine is particularly advantageous because it has a very high electron capture cross-section and because its recombination rate after dissociation is nearly 100%. The temperature stability and long life of bromine are also outstanding. For this reason, bromine quenched counters can be used continuously at temperatures of 300° C. and for short terms at temperatures as high as 400° C.

A desirable attribute of a GM detector is high sensitivity or ability to detect low levels of ionization. To insure high sensitivity, the cathode is typically plated with an inert and dense (non-porous) layer of a metal such as platinum. Care must be taken to insure that the platinum is plated on the cathode as a coherent, non-porous layer. Among factors involved in insuring an adherent electroplate are the type of substrate surface used for the cathode, thoroughness of surface cleaning and preparation, characteristics of the plating bath, and plating conditions such as current density, temperature, presence or absence of bath impurities, etc. Deviation from optimum can lead to the formation of a porous deposit and attendant premature loss of cathode sensitivity.

One criterion of performance of a GM tube is the uniformity of the count-rate over the entire span of operational voltages during which the count-rate is relatively independent of voltage. This stability persists over a wide range of operating temperatures. The plateau should occur in the high voltage range thereby resulting in an improved pulse height and time resolution. The voltage approaches that value necessary to initiate spontaneous discharge between the conductive anode and cathode. A standard halogen quenched GM tube manufactured by The Harshaw Chemical Company typically exhibits a count-rate shift less than 2.5% and a slope of 8% over a range of 100 volts at a temperature ranging from −40° C. to 225° C. and an operating voltage range of 800 to 1000 volts.

In U.S. Pat. No. 3,892,990, a halogen quenched GM tube having extended life and high temperature operability is described. The improved characteristics of the tube are achieved by coating a stainless steel cathode with a thin layer of chromium, platinum or an alloy of nickel and copper, followed by passivation of the surface by successively filling the tube chamber with halogen gas under pressure and purging the chamber to passivate the cathode until starting voltages are essentially constant after which a fresh charge of halogen gas is sealed in the chamber.

As mentioned in this patent, the inner surface of the stainless steel cathode can be plated with a thin layer of an alloy containing a major amount of nickel and a minor amount of copper. However, no particular advantages were noted with this alloy when compared with those plated with chromium, and in fact, when the nickel alloy contains substantial amounts of copper, electroplating of the same on the cathode surface becomes difficult. For most purposes, platinum is preferred because of its high sensitivity to gamma radiation. However, problems are encountered in the adhesion of platinum when it is plated on the inner surface of larger stainless steel tubes having a diameter of 1" or so. Another problem that is encountered with a very thin layer of platinum is its porosity. When using bromine or chlorine as a quench gas, the porosity of the platinum permits the free halogen in the gas to attack the stainless steel cathode. As the operating temperature increases, the rate of attack is greater. This causes the performance of the tube to degenerate with a drop in the starting voltage, a downward shift in the plateau and an attendant increase in the slope throughout the operating range of the counter. Substituting nickel cathodes or copper cathodes for the stainless steel does not solve the problem because nickel is too soft for the demanding physical requirement of these tubes and is not resistant to free halogen attack. Copper suffers the same problems and is even more vulnerable to attack.

BRIEF DESCRIPTION OF THE INVENTION

In light of the foregoing, it is therefore unexpected that the use of nickel copper alloy for the cathode of a GM detector would permit the construction of a detector having (1) outstanding resistance to attack by halogen quenching gases, (2) a slope over the plateau range of voltages as low as 1% or less, and (3) a negligible drop in starting voltages or shift in the plateau upon prolonged use. Yet these results are achieved in a detector constructed according to the teachings of the present invention by use of a relatively large surface cathode made from a nickel copper alloy composed predominently of nickel. The alloy preferably contains from 60 to 70% nickel and 35 to 25% copper. Alloys of this type are sold by the International Nickel Company under the trademark Monel. Even more unexpected is the high sensitivity which is achieved when a thin layer of platinum is plated on the inner surface of the cathode.

Referring briefly to the drawings, FIG. 1 is a side view, partially in cross-section, or a typical Geiger-Mueller tube;

DETAILED DISCUSSION OF THE INVENTION

Figure 1:
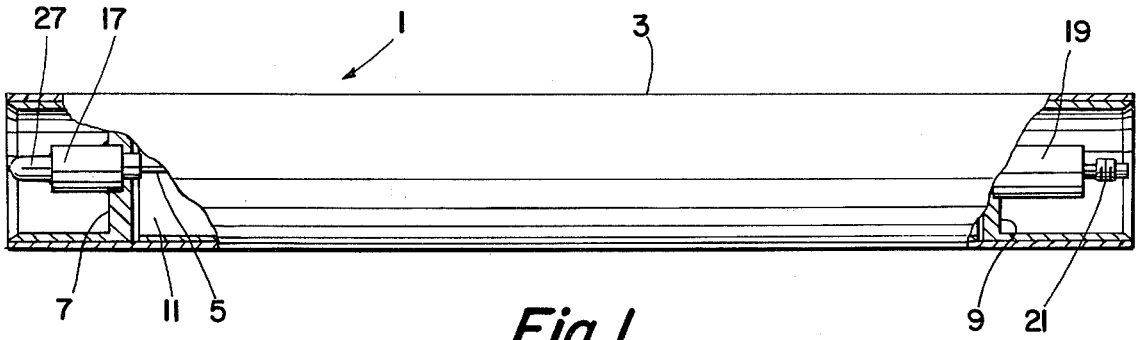

Referring now more specifically to the drawings, FIG. 1 shows a conventional GM detector 1 consisting of a tubular or cylindrical metal cathode 3, a wire anode 5 concentrically disposed within the cathode, and end caps 7, 9 welded to the cathode defining an enclosed chamber therewith. The chamber is filled through a glass tube 27 at one end with a gaseous mixture comprising an ionizing gas, a minor amount of a quenching gas and an inert gas. A typical mixture is 0.1% argon, 1.5% bromine and the remainder neon. Each end of the wire anode is anchored in a ceramic collar 17, 19 and threaded coupling 21 is provided at the other end for connecting the tube to a suitable radiation counting and measuring system, not shown.

Figure 2:
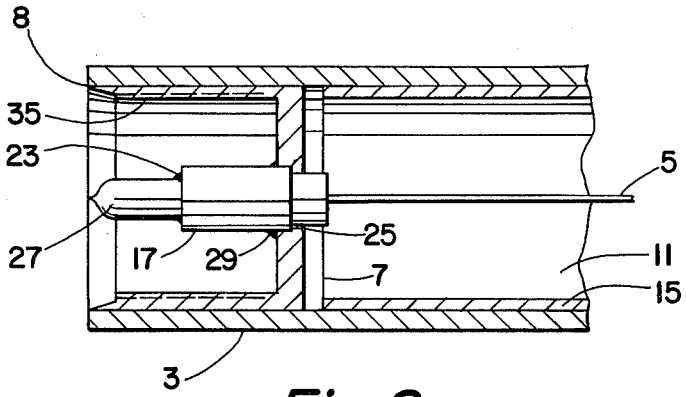
FIG. 2 is an enlarged cross-section of one end of the tube.

As shown in FIG. 2, one end of the cathode 3 is sealed off with a cup-shaped end cap 7, fabricated from a metal such as 446 stainless steel and welded along the rim at 8 to the cathode 3 by, for example, heliarc welding. A ceramic collar 17 fits in an annular hole in the end cap and is seated on shoulder 25. One end of the wire anode 5 is anchored in the collar. A suitable sealant such as solder glass is used to form an air tight seal 29 between the collar and the end cap. The coefficient of expansion of the sealant should closely approximate that of the ceramic collar and stainless steel cap to prevent cracking during thermal cycling.

An annular passageway (not shown) extends through the collar and through glass tip 27 to permit a vacuum to be drawn and gas to be introduced into the tube. When the purging and filling are complete, the glass tip 27 is heated and closed off to permanently seal the gases within the tube. The junction between the tip 27 and collar 17 is made air tight using a suitable sealant 23 such as solder glass. These details concerning construction of the GM tube are well-known and do not comprise part of the present invention.

The interior annular wall of the end cap is provided with threads 35 to permit the tube to be screwed onto a manifold through which the tube is pumped down, conditioned and filled with the gaseous mixture.

The cylindrical cathode 3 of the present invention is fabricated from an alloy of nickel and copper, containing nickel as the predominant metal. One alloy that has been found to be ideally suited for this purpose is Monel® alloy sold by the International Nickel Company. Monel 400 exemplifies this family of alloys and contains 66% nickel and 31.5% copper with minor amounts of iron, manganese and silicon. This alloy has a coefficient of expansion of $7.7\times10^{-6}$ inches/°F. It is understood that the present invention is not limited to this one alloy, but, instead embraces a wide variety of nickel-copper alloys containing at least 50% nickel, preferably between 60% and 70% nickel and 25% and 35% copper.

The inner surface of the cylindrical cathode 3 is coated with a thin layer 15 of platinum, preferably by electrodeposition, from a suitable plating bath. Standard plating baths for this purpose use an electrolyte such as platinum diammino dinitrate as well as proprietary additives to promote conductivity, leveling and adhesion. The platinum is deposited in an amount of 15 milligrams per square centimeter to form a deposit having a thickness of 0.2 mils. This thickness provides a non-porous layer which is resistant to attach by the halogen with no sacrifices in sensitivity. The thickness can be varied depending on the source of the radiation being measured and the sensitivity to be desired. The platinum layer is preferably electrodeposited along the entire length of the Monel tube after which a portion at each end is removed by suitable means such as grinding to permit the end cap 7 to be inserted into the tube and welded in place. Alternatively, the ends of the tube may be shielded or masked so that, during electroplating, the platinum is not electrodeposited at the ends of the tube. It is noted that very little if any galvano-corrosion occurs at the interface between the platinum plated Monel cathode and the stainless steel end caps.

The tube is preferably passivated and conditioned according to the teachings of U.S. Pat. No. 3,892,990, the subject matter of which is incorporated herewith by reference. According to this patent, the tube is heated at a temperature of 350°–400° C. for about two hours under vacuum after which an oxygen containing gas is introduced at a positive pressure of 2 or 3 mm of Hg. A high voltage is applied to ionize the gas and to cause formation of an oxide layer on the entire inside surface of the cathode.

Following the oxidation, the remaining oxygen is withdrawn from the tube which is allowed to cool down. The tube is then filled with a gaseous mixture containing an ionizing gas, the halogen quench gas and an inert gas such as neon to a positive pressure of 1–10 mm of mercury.

A high frequency power source is connected across the terminals to generate halogen ions which are absorbed on the surface of the cathode and the wire anode. The tube is then cooled and the high frequency source is again applied one or more times until the absorption saturation end point is reached. The saturation gas is then pumped out and the tube is filled with a final fill gas containing the halogen gas and an inert gas, with repeated pressurizing over a period of several days until the starting voltage becomes constant.

Figure 3:
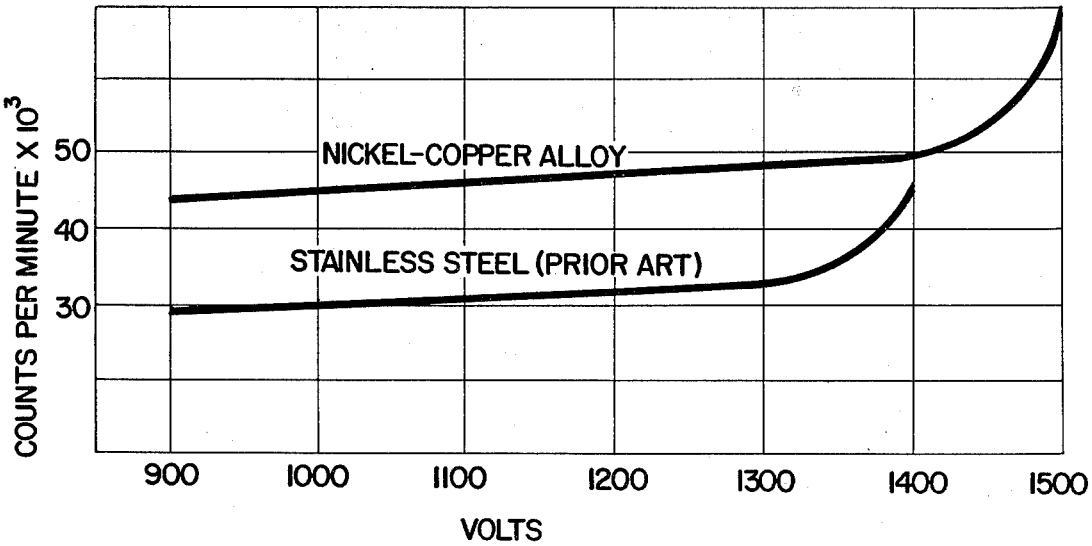
FIG. 3 is a graph comparing the performance characteristics of an improved tube of this invention with that of a prior art GM tube.

The operating characteristics of this improved tube compare very favorably with those of a similar tube using a stainless steel cathode plated with platinum. In a test using a Type G-22 GM tube manufactured commercially by The Harshaw Chemical Company, using a stainless steel cathode, the plot of operating voltage versus count-rate is depicted in FIG. 3 and shows a slope of approximately 2% over the operating range of 1,000–1,300 volts. Compared with this is a slope of an identical tube using a platinum plated Monel cathode. The tube is capable of operating at a higher range of 1,100–1,400 volts. The slope over this higher range with the improved cathode is less than 1% and the tube shows greater sensitivity with a count rate approximately 15,000 counts per minute higher than for the prior art tube.

A G-22 Geiger-Mueller counter tube manufactured by The Harshaw Chemicl Company using a Monel cathode was tested at room temperature and at 200° over a range of 900–1,400 volts to determine high temperature stability. This tube which uses a 0.010 thick Monel cathode, having an outer diameter of $\frac{5}{8}$ of an inch and plated on the inner surface with 15 mg/cm$^2$ of platinum, showed no divergence of count-rate through the entire voltage range until voltage has reached 1,300 volts after which spontaneous dissociation began to occur quite rapidly at the elevated temperatures. A G-26-6″ type counter with a 0.290 outer diameter, 0.02 thick Monel cathode plated with 15 mg per square centimeter of platinum was tested for stability at room temperature and was found to have a negative voltage variation of less than 1 volt over a duration of 1,800 hours of continuous operation.

Generally speaking, the teachings of the present invention are applicable to GM tubes irrespective of size. Commercially available GM tubes ranges in size from about $\frac{1}{4}$″ O.D. to 1″ O.D. with active lengths of between 2″ and 17″. The ends of the tube between the cathode and wire anode are sealed by suitable means depending on the inner diameter of the cathode. For example, with tubes less than $\frac{1}{2}$″ in diameter, the ends are filled with a non-conductive ceramic glass composition having a coefficient of expansion which matches that of the Monel. Where the cathode is larger than about $\frac{1}{2}$″ I.D., a stainless steel cap of the type shown in FIGS. 1 & 2 is used.

Other variations can be made in the design of this improved Geiger-Mueller tube without departing from the scope of the present invention.

We claim:

1. In a Geiger-Mueller radiation detector including a sealed chamber defined by a cylindrical cathode and two end caps, a wire anode disposed within said chamber concentrically with respect to said cathode and a gaseous mixture confined in said chamber and comprising predominantly an inert gas and minor amounts of an ionizing gas and a halogen quenching gas, the improvement comprising the use of a cathode consisting of an alloy containing between 60 and 70% nickel and between 35 and 25% copper and having a thin layer of platinum electrodeposited on the interior surface thereof.

2. The detector of claim 1 wherein the platinum is electrodeposited on the surface in an amount of approximately 15 mg/cm$^2$.

3. The detector of claim 1 wherein the change in the count rate over the entire range of operating voltages is less than 1%.

* * * * *